United States Patent [19]

Buehner

[11] 4,187,810

[45] Feb. 12, 1980

[54] POPPET VALVE STROKE ADJUSTING DEVICE FOR, AND COMBINATION WITH, AN INTERNAL COMBUSTION VALVE IN HEAD ENGINE

[76] Inventor: Joseph F. Buehner, 6750 State Rd., Wadsworth, Ohio 44281

[21] Appl. No.: 878,800

[22] Filed: Feb. 17, 1978

[51] Int. Cl.[2] ..... F01L 1/34

[52] U.S. Cl. ..... 123/90.16; 123/90.39; 123/90.46

[58] Field of Search ..... 123/90.16, 90.39, 90.46, 123/90.2

[56] References Cited

U.S. PATENT DOCUMENTS

| | | | |
|---|---|---|---|
| 1,395,851 | 11/1921 | McLean | 123/90.39 |
| 1,654,020 | 12/1927 | Schmidt | 123/90.39 |
| 2,053,743 | 9/1936 | Russell | 123/90.46 |
| 3,273,546 | 9/1966 | Von Arx | 123/90.39 |
| 3,367,312 | 2/1968 | Jonsson | 123/90.16 |
| 4,077,369 | 3/1978 | Buehner | 123/90.39 |

*Primary Examiner*—Ira S. Lazarus
*Assistant Examiner*—Jeffrey L. Yates
*Attorney, Agent, or Firm*—John Harrow Leonard

[57] ABSTRACT

A power driven valve stroke adjusting device, remotely controlled, is operable for adjusting the length of stroke of a spring returned poppet valve of a valve-in-head internal combustion engine in which the valve is driven by an associated valve operating rocker on the head, operated by a push rod which, in turn, is driven by a tappet which is lineally reciprocable axially and concurrently rotatable about its axis. The device is carried on the rocker and is operable to adjust the valve stroke for opening the valve by the rocker from starting position of the valve to a long-stroke open position or to a short-stroke open position, selectively. The adjustment is effected during engine operation and without any hindrance to tappet rotation and without any change in the timing relation between the tappet and its operating cam, all while maintaining a zero or fixed preselected clearance between the rod and the rocker and between the rod and the tappet in the starting position of the valve. The device can be installed on a conventional engine, to provide therewith an operating combination, by replacing the existing rocker, with a rocker on which the device is installed. A plurality of the devices, one for each valve, or one for each of a selected group of valves, may be provided for a multi-valve engine, and may be adjusted in unison to like operating positions from a single remote control source.

10 Claims, 10 Drawing Figures

FIG. 1
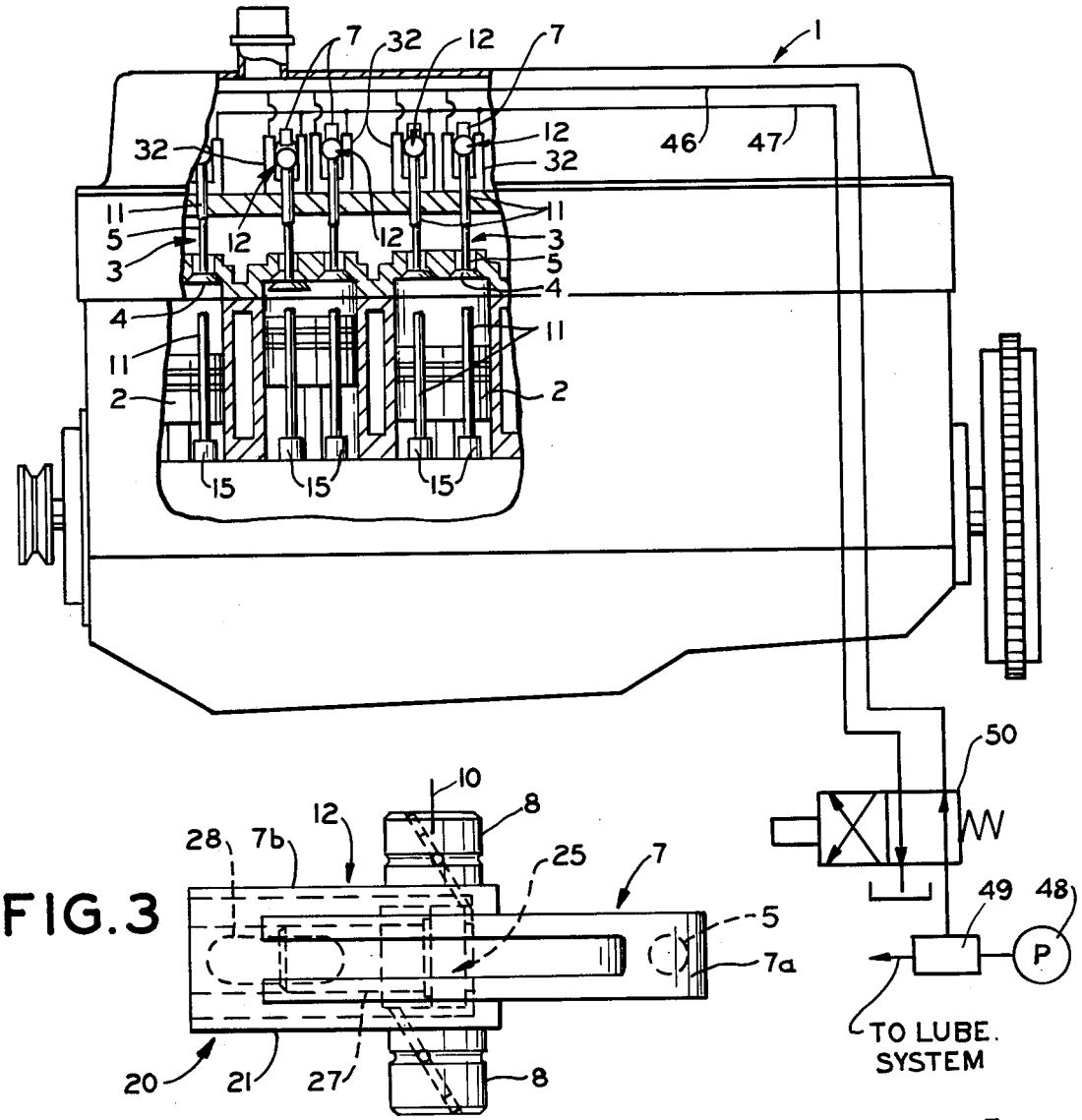
FIG. 3
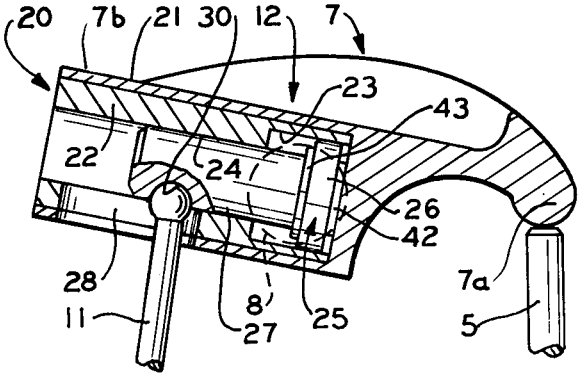
FIG. 4
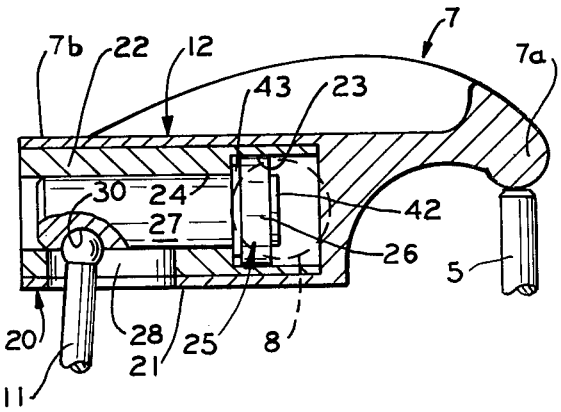
FIG. 5

FIG. 6
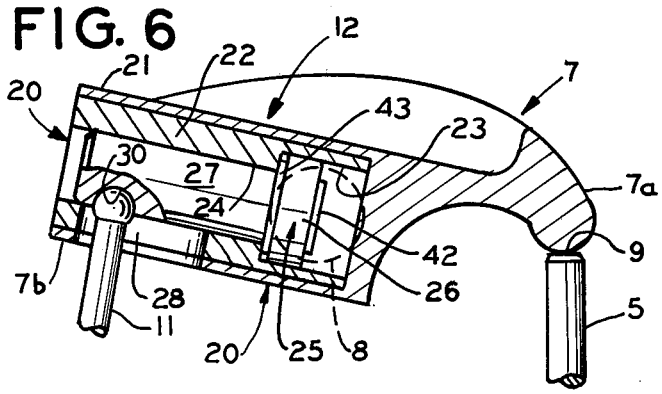
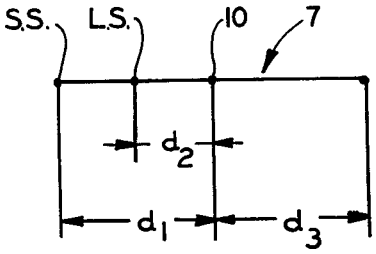
FIG. 10
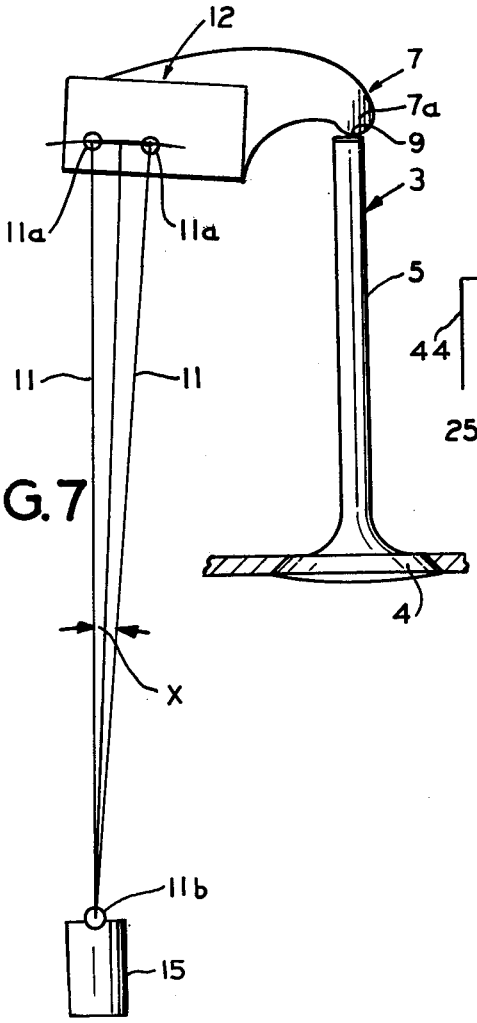
FIG. 7
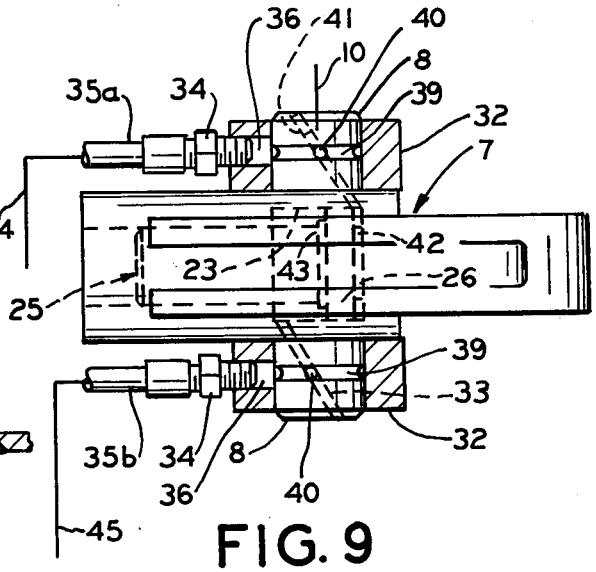
FIG. 9
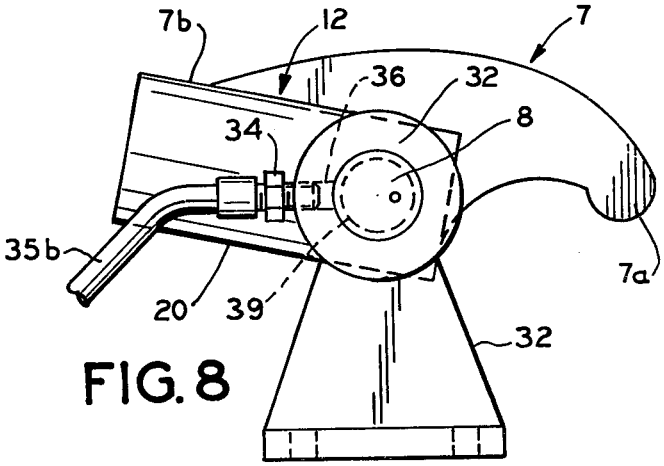
FIG. 8

POPPET VALVE STROKE ADJUSTING DEVICE FOR, AND COMBINATION WITH, AN INTERNAL COMBUSTION VALVE IN HEAD ENGINE

BACKGROUND OF INVENTION (1) Field of Invention

Engine poppet valve stroke adjusting device.

(2) Prior Art

Heretofore, as more fully described in my copending U.S. patent application, Ser. No. 679,004, filed Apr. 21, 1976, now U.S. Pat. No. 4,077,369, attempts prior thereto had been made to modify the length of stroke of the valves of internal combustion engines. In most of the prior structures the stroke adjustments introduced concurrent changes in the timing cycles, generally in the ultimate time cycle relation between the valve operating tappet and its driving cam. This creates a concurrent change in both the time of initiation of the opening, and the time of closing, of the valve, in relation to the engine rotation, whether the change be an advance or a retardation.

In my above identified copending application, the valve stroke adjustment device is operatively interposed between a conventional valve operating rocker on the engine head and an additional supplemental rocker added to the engine and driven by the valve tappet, either directly or through the medium of a conventional push rod.

SUMMARY

In accordance with the present invention, the supplemental rocker is eliminated and the valve adjustment device is mounted directly on one arm of a valve operating rocker on the head of the engine in a manner to effect stroke adjustment, while the other arm of the same rocker directly engages the valve. The rigid push rod for driving the rocker and valve in the opening direction of the valve is driven directly by the lineally reciprocable tappet in the customary manner, and its connection at its lower end to the tappet is such that the rotation of the tappet about its axis remains unimpaired and normal, regardless of the adjustment of the stroke of the valve. The upper end of the rod engages and drives the device, and thereby the valve operating rocker, in all adjusted positions. The adjustments of the length of valve stroke, always starting from the same closed valve starting position, are effected by swinging the push rod about its lower end as a center, transversely of its length, toward and away from the rocker axis to long and short stroke positions, respectively, by the device. The center of the upper end of the rod swings in an arc about the center of the lower end, and consequently, in the closed valve starting position, the center of the upper end of the rod lies at one end of a chord of that arc in the long stroke adjusted position and at the other end of the same chord in the short stroke adjusted position. Thereby the timing of the initiation of the opening of the valve remains unchanged relative to the cam, only the degree of opening of the valve from starting position is adjusted.

Thus the operating characteristics and advantages of the device in my copending application are retained and the higher inertial forces introduced thereby by the additional or supplemental rocker are eliminated. Furthermore, the devices themselves can be installed on the engine simply by removing the conventional valve operating rockers and replacing each of them with a rocker with one of the adjustment devices installed thereon, and then connecting the devices to the existing push rods, respectively. Only the hydraulic connections for the devices, as disclosed in my copending application, need be added to the engine and connected to its oil circulating pump.

Various other objects and advantages will become apparent from the following description in which reference is made to the drawings.

BRIEF DESCRIPTION OF THE DRAWING

FIG. 1 is a fragmentary side elevation of a conventional internal combustion gasoline engine, showing valve stroke adjustment devices of the present invention combined therewith, part of the engine being broken away to show more clearly the relation of the cooperating parts in the resultant combination;

FIG. 3 is a top plan view of a valve rocker and adjustment device of the present invention with the device set in the long stroke, closed valve, position illustrated in FIG. 2;

FIG. 4 is a side elevation, partly in section, of a valve rocker and stroke adjustment device of FIGS. 2 and 3, with the device in the long stroke, but open valve, position;

FIG. 5 is a side elevation similar to FIG. 4, but showing the device in the short stroke, closed valve position;

FIG. 6 is a side elevation, partly in section, similar to FIG. 5, showing the device in short stroke, but open valve position;

FIG. 7 is a diagrammatic side elevation showing proper relation between one of the adjustment devices and its associated valve operating rocker and rod, with the adjustment device in the long stroke and short stroke positions, in the closed valve position;

FIG. 8 is a side elevation of one of the rockers, with its adjustment device, the mounting for the rocker, and the passages for delivery and return of operating pressure fluid to and from the device;

FIG. 9 is a top plan view, partly in section, of the structure illustrated in FIG. 8; and FIG. 10 is a diagrammatic illustration of exemplary dimensional relations of the long stroke and short stroke settings of the device relative to the illustrative rocker.

DESCRIPTION OF THE PREFERRED EMBODIMENT

Figure 2:
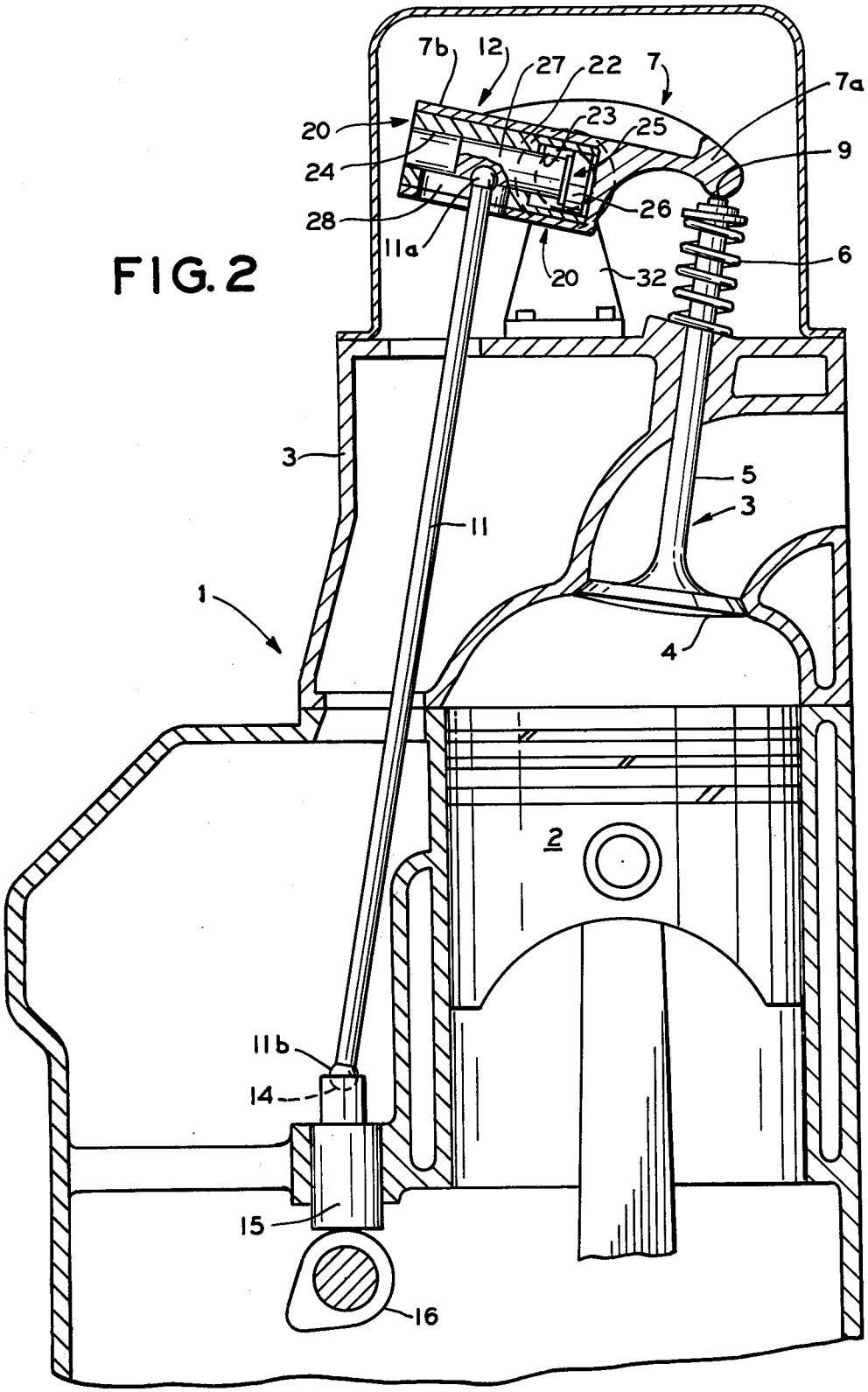
FIG. 2 is an enlarged fragmentary vertical cross sectional view of part of the engine and one of the adjustment devices of FIG. 1, showing the valve in closed position and the device set for normal long stroke valve operation.

Referring to the drawings, the specific adjustment device is shown for illustration as installed on a conventional six-cylinder internal combustion gasoline engine 1, such as is commonly used in trucks. The engine includes a plurality of cylinders 2, each with conventional overhead poppet valves 3 mounted in the usual manner in the conventional detachable head of the engine.

The valves are arranged in pairs, two for each cylinder, one valve of each pair being an intake valve and one being an exhaust valve. The structure and functioning of the stroke length control device is the same for each type of valve of each cylinder and, accordingly, only one valve and its control device is referred to in detail herein. Generally, all valves are adjusted concurrently but, if desired, the exhaust group can be controlled independently of the intake group, simply by using separate reversing valves and manifolds for the groups, respectively.

As illustrated in FIGS. 1 and 2, each valve comprises a head 4 and stem 5, and is normally seated by a return spring 6. The valve is opened by a valve operating rocker 7 having a valve engaging arm *7a* and a rod operated arm *7b*. The rocker is mounted on the detachable head of the engine on trunnions 8 for rocking about a fixed axis 10 which is preferably directly opposite and in the same horizontal plane as the point of contact, indicated at 9, of the valve engaging arm *7a* with the upper end of the valve stem 5. The other arm *7b* of the rocker 7 is disposed at the opposite side of the axis 10 from the arm *7a*, as shown in FIGS. 3 and 4. As will be described later, the valve 3, by way of the rocker 7, is operated by an elongated push rod 11. As shown in FIG. 2, the upper end 11*a* of the rod 11 is in the form of a ball or sphere and is disposed in a complementary socket on an adjustment element of the stroke adjustment means 12 of the present invention, as later described. The lower end 11*b* of the rod 11 also is in the form of a ball or sphere and engages in an upwardly open conventional socket 14 in a conventional hydraulic tappet 15 which, in turn, is driven by the conventional cam 16 of the engine. The tappet 15 is guided for movement endwise or axially along a lineal path, extending generally endwise of the rod 11, for causing the rocker 7 to open the valve 3 against the force of the return spring 6. The tappet is, and must remain, rotatable about its axis during its reciprocation. The ball and socket connection between the lower end of the rod and the wall of the socket 14 is such that the rotation of the tappet about its axis by its associated cam is not impaired by the rod or by anything driven by the rod.

From the foregoing it is clear that no operation of the stroke adjusting device 12 can change the timing relation between the cam 16 and tappet 15 in relation to the revolutions of the engine.

As best illustrated in FIGS. 2 through 4, the stroke adjusting means 12 includes driven means which comprises a cylinder 20, preferably in the form of an outer shell 21 with an inserted sleeve 22 in which is a cylinder bore 23 and a coaxial smaller diameter bore 24. The driving means also includes a piston, indicated generally at 25, having a head 26 reciprocable in the bore 23 and a rod 27 reciprocable in the bore 24. The cylinder 20 has on its underside an elongated slot 28 which extends from the outer surface of the cylinder 20 inwardly into the bore 24.

The tappet 15 is preferably of the hydraulic type which functions in the conventional manner, being reciprocable axially and concurrently rotatable about its axis by its cam. The lower end 11*b* of the push rod 11 is seated in the socket 14 in the upper end of the tappet 15. The upper end 11*a* of the rod 11 is also seated in a complementary socket 30 in the piston rod 27. Thus it will be seen that, in the closed valve position, as the piston 25 is moved from its extreme retracted position to the right in FIG. 2 to its extreme extended position to the left, it causes the rod 11 to swing transversely of its length about its lower end 11*b* as a center. As a result, the center of the upper spherical end 11*a* of the rod 11 swings in an arc about the center of the lower spherical end 11*b* as the rod 11 is shifted to and from its long stroke position, in which it is closest to the axis 10 of the trunnions 8, from and to its short stroke position in which it is furthest from the axis 10 of the trunnions 8.

Since the travel of the piston 25 is lineal in relation to its rocker, it is apparent that the center of the upper spherical end 11*a* cannot follow this arch while retaining its normal contact in the socket 30 without, at the same time, rocking the rocker 7 about its axis 10. However, the lineal path of the piston 25 and the arcuate path of the end 11*a* are related so that, with zero or predetermined operating clearance between the spherical upper end 11*a* of the rod 11 and its socket 30 in the piston stem 27, in the closed valve position, the center of the upper end 11*a*, in both the left hand or short stroke position and the right hand or long stroke position, must be on this arc. But the end 11*a* can lie on this arc, with the closed valve position of the rocker, the same in both long and short stroke positions, only if they are at opposite ends of the same chord defined by the lineal path intersecting the arcuate path.

As best illustrated in FIG. 7, the positions of the center of the upper end 11*a* along the lineal path parallel to the piston axis, in the long and short stroke positions, are at the intersections of the chord C, defined by the lineal path with the arc A. These points are equidistant from the intersection of a bi-sector of the angle x, through which the rod 11 swings in passing from long stroke to short stroke positions and reverse. Thus, regardless of the particular engine, the selection of the long stroke and short stroke positions of the center of the upper end 11*a* on the intersections of this chord and arc assures that the operating clearance between the rocker and rod remains the same in the retracted or long stroke closed valve position as in the extended or short stroke closed valve position.

Since this shifting of the rod 11 by the device 12 does not in any respect change the relation of the rocker and valve in the closed position of the valve, the instant of initiation of the valve opening is always the same, relative to the cam position, in both long stroke and short stroke positions, only the degree of opening, not the timing of the opening relative to engine revolution being adjusted, while the tappet remains freely rotatable about its own axis.

Referring to FIGS. 8 and 9, a preferred form of rocker, adjustment means and mounting of the rocker are illustrated, and show also a preferred relation of the adjustment positions of the piston 25 of the adjustment means 12 in relation to the rocker 7. This preferred arrangement of parts is designed to reduce to a minimum the inertial forces which heretofore had resulted from the addition of a supplemental rocker and which otherwise be imposed on the rocker by the adjustment means 12, and at the same time, to simplify the introduction and discharge of hydraulic operating fluid to the cylinder bore 23.

First, the rocker is cored for reduction to a minimum of its weight and any overbalance about its rocking axis. The cylinder 20 is arranged so that the piston head 26 is as near as practical to the axis 10 of the trunnions 8 in both the extended and retracted positions of the piston 25. To this end the cylinder bore 23 extends to the right hand side, in FIG. 4, of the axis 10 a distance such that the entire piston head 26, in its retracted position for long stroke, the right hand position in FIG. 4, is to the right of, or closely adjacent, to the axis 10. Preferably the piston head 26 is of such extent axially that in this right hand position its left hand face is substantially at the axis 10. The cylinder bore 23 is of such length that when the piston 25 is moved to its short stroke or fully extended position, the right hand face of the piston head 26 is substantially at the axis 10. Deviations from this theoretical position are made to compensate as near as possible for any overbalance of the piston stem or the piston head relative to the axis 10 so that the center of gravity of the rocker as a whole, including the adjustment device 12, is as near as may be to the axis 10 at all times. This greatly reduces the dynamic inertial forces imposed when the rod 11 drives the rocker 7 in the valve opening direction. Further, it reduces any tendency of the valve to overrun, due to inertial forces, in the opening direction at high speed.

To reduce additional inertial forces that would be imposed were the fittings and hoses, through which the operating fluid is supplied to the cylinder bore 23, mounted to rock with the rocker 7, the trunnions 8 are mounted in supports 32, which may be bolted or otherwise secured to the top of the head of the engine in a conventional manner. The supports 32 are preferably positioned so that all of the rockers 7 rock about a common axis, such as the axis 10. The supports are provided at their upper ends with bearings 33, each of which has a central opening that received and embraces one of the trunnions 8 with close operating clearance. Pressurized oil for operating the piston 25 in opposite directions is supplied by way of fittings 34 and flexible supply lines 35*a* and 35*b*, line 35*a* leading to one trunnion of a rocker and line 35*b* leading to the other trunnion of the same rocker. Instead of mounting the fittings 34 and supply lines for rocking with the associated rockers 7, they are mounted on the bearings 33 of the supports 32. Since the fittings 34 and hoses 35*a* and 35*b* are the same for each bearing 33, only one set, with its supply and return ducts, is described in detail.

Each bearing 33 has a duct 36 which connects at one end with the duct in the fitting 34, and at its other end opens into the central opening of the bearing 33. To deliver and vent, selectively, the fluid thus supplied each trunnion is provided with a circumferential groove 39. Further, each trunnion 8 is provided with a transverse duct 40 which opens at one end into the associated groove 39 and, in turn, is connected at its opposite end with a duct 41. The duct 41 of one trunnion leads to one end of the cylinder bore 23 of the adjustment means 12, and the duct 41 of the other trunnion 8 of the same rocker leads to the opposite end of the same bore 23.

In order to assure that the fluid can fully enter the cylinder bore 23, and to assure that the piston is held firmly in its extended and retracted positions, respectively, the piston head 26 is provided at the end facing the head end of the bore 23 with a shoulder 42 and at the end facing the rod end of the bore 23 with a shoulder 43. These shoulders are arranged so that the piston head 26 is kept slightly spaced from the ends of the cylinder in its extreme positions to assure admission of fluid, and yet is mechanically held firmly from overrunning the selected extended or retracted position under the pressure of the live fluid.

Thus by admission of fluid through the selected line 35*a* of one trunnion 8 to one end of the bore 23 at the right end of the bore 23 while venting the fluid, through the line 35*b* of the other trunnion, from the left end of the bore 23, the piston 25 is driven to the left to an extended position. Upon reversal of the flow of operating fluid through the lines 35*b* and 35*a* pressure fluid is admitted to the left end of the cylinder bore 23 and is vented from the right end of the bore 23, thus driving the piston 25 to the right. With this arrangement, there are no rocking or moving auxiliary supply and venting fittings and hoses which would add to the inertial forces.

Here it is to be noted that, even in idle position, the tappet and rod exert an upward component of force on the left arm 7*b* of the rocker 7 and the return spring of the valve exerts an upward component of force on the right arm 7*a*, so that, in general, the trunnions 8 are held most firmly against the upper walls of the central bores of the bearings 33, leaving slightly greater clearance between the trunnions and the bottom walls of the central opening of the bearings. Since both the flow of oil and pressure thereof are large compared to that required for operating the pistons 25, there is ample pressure and volume to operate the piston while, at the same time, flushing out the space between the trunnions and bearings 33 with excess oil. Thus dynamic inertial forces due to loads eccentric to the axis 10 are reduced to a minimum.

If, as described in my earlier copending application, a plurality of the stroke control devices are to be operated concurrently they may be operated by the hydraulic system of the engine, as disclosed theretin. In such case the lines 35*a* may be connected to a common manifold 44 and the lines 35*b* to a common manifold 45. These manifolds, in turn, are connected by lines 46 and 47, respectively, to the pump 48 of the engine through a conventional pressure regulator 49 and reversing valve 50, as described in my above identified copending application. If either the group of intake valve or the group of exhaust valves is to have the strokes of a selected one of the groups adjusted independently of the other group, then two reversing valves, one with manifolds for one group and one with manifolds for the other group, may be employed.

As exemplary of the specific engine herein shown, reference is made to FIG. 10 wherein the rocker, indicated at 7, rocks about the axis 10 of the trunnions 8. The distance of the upper end of the rod 11 from the axis 10 for short stroke is indicated at $d_1$ and the distance for long stroke is indicated at $d_2$. The fixed distance from the axis 10 to the outer valve engaging end of the arm 7*a*, is indicated at $d_3$. For short stroke, $d_1$ is approximately equal to $d_3$. For long stroke, $d_2$ is approximately $\frac{1}{2}$ of $d_3$. Thus, assuming $d_3$ is $1\frac{1}{2}$ inches in a particular engine, the distance $d_2$ would be about $\frac{3}{4}$ of an inch for the long stroke. For the short stroke, about $\frac{5}{8}$ of an inch would be added to $d_2$ to equal $d_1$, thus makin 11/8 of an inch. This, of course, would be 11/12 of $d_3$ which is 12/8 inches. These proportions, of course, would have to be varied depending upon the specific engine and timing.

Having thus described my invention, I claim:

1. A valve stroke control device for an overhead poppet valve internal combustion engine having a removable head, a poppet valve mounted in the head, a return spring for returning the valve from open to closed position, a timing gear train, a rotatable cam driven by the train, a reciprocable tappet carried by the engine and movable axially in opposite directions, respectively, and driven by the cam in one of said directions for opening the valve, and returned to starting position by the return spring;

a rocker mounted on the engine head for rocking about a fixed axis from a starting closed valve position, in one direction in which said rocker opens the valve, and in an opposite direction in which said rocker permits returning of the valve to closed position by the spring;

said rocker having a valve engaging portion spaced a fixed distance from its rocking axis and by which the driving force imparted by the tappet is applied to the valve for opening the valve, and having a drive force receiving portion on said rocker and spaced at the opposite side of the rocking axis from the valve engaging portion;

adjustment means fixedly mounted on said force receiving portion of the rocker for rocking therewith and including an adjustment element movable relative to the rocker transversely of said rocking axis in opposite directions from a long stroke position spaced a predetermined distance from said rocking axis to a short stroke position which is a different distance from said rocking axis than said predetermined distance;

an elongated push rod;

first connecting means connecting one end of the rod to the driving end of the tappet so that the rod is driven by the tappet in the valve opening direction, and so that the rod is swingable about said one end as a center toward and away from said rocker axis;

additional connecting means connecting the other end of the push rod to said element for movement of said other end with the element in said opposite directions for swinging the rod transversely of its axis about said one end of the rod by the element, to said long stroke and short stroke positions, respectively, of said element and for concurrent movement of the rod along the rod axis with the element in said long stroke and short stroke positions, respectively, as the element rocks with the rocker in each of said positions;

said adjustment means further including driving means for driving said element in said opposite positions, selectively, independently of the rotated position of said cam and for holding the element in the selected one of the positions, thereby to move said other end of the rod to said long stroke and short stroke positions, selectively;

said element being arranged so that said starting position of the valve is the same in both said long stroke and short stroke positions of the element and rod and while the timing relation between the cam and the initation of valve opening remains unchanged; and power means for supplying power to the driving means, and remotely controllable means operable to control the delivery of power to the driving means in a manner to drive said element to said long stroke and short stroke positions, selectively, and to hold the element in the selected one of said positions.

2. A valve stroke control device according to claim 1 wherein said element is movable along a predetermined path in said opposite directions, and said path is related to the arc defined by said other end of the rod as it swings about the said one end as a center so that the rocker on the head returns to the same starting valve-closed position in both the long stroke position of the rod and the short stroke position of the rod.

3. A valve stroke control device according to claim 2 wherein said predetermined path is lineal relative to the rocker and coincides with said arcuate path of said other end of the rod at opposite ends of a chord of said arcuate path in said long stroke and short stroke positions, respectively.

4. A valve stroke control device according to claim 1 wherein said driving means of said adjustment means includes a cylinder and a piston reciprocable therein, said element is part of the piston and said cylinder extends transversely of said rocking axis and has one end positioned at least close to said rocking axis.

5. A valve stroke control device according to claim 1 wherein said driving means of said adjustment means including a cylinder and a piston reciprocable therein, said element is part of the piston, said cylinder extends transversely of said rocking axis from a location spaced from said axis at the same side thereof as the valve engaging portion of the rocker to a location spaced from said axis at the same side thereof at the receiving portion of the rocker.

6. A valve stroke control device according to claim 5 wherein the piston has a head related in length to the cylinder and its stroke so that, in the long stroke position, the rod face of the piston head lies at the same side of, and close to, the rocking axis as the valve engaging portion of the rocker and in the long stroke position the head face of the piston lies at the same side of, and close to, the rocking axis as the receiving portion of the rocker.

7. A valve stroke control device according to claim 1 wherein said driving means of said adjustment means includes a cylinder and a piston reciprocable therein, said element is part of the piston, said piston extends transversely of said rocking axis; said rocker has coaxial trunnions extending transversely of the rocker and coaxial with said rocking axis and arranged at opposite sides of the rocker, respectively; bearings are provided and are mounted on the head at opposite sides of the rocker, respectively, in coaxial relation with the rocking axis; said trunnions are mounted in said bearings, respectively, and are supported thereby for rocking relative thereto; conduit means are connected to the trunnions, one to each trunnion, each for supplying and venting fluid, selectively, to and from its associated trunnion; each trunnion has internal duct means; the internal duct means of one trunnion connect its associated conduit means to one end of the cylinder and the internal duct means of the other trunnion connect its associated conduit means to the other end of the cylinder.

8. A valve stroke control device according to claim 7 characterized in that the conduit means for each trunnion comprise a conduit connected in fixed position to the bearing of the associated trunnion; each bearing has a duct connected at one end to its said conduit means and opening at its other end into the trunnion receiving opening in the bearing, each trunnion has a port on its circumferential surface in continuous communication with said duct and has internal duct means connected at one end to said port and the internal duct means of one trunnion being connected at its opposite end with one end of the cylinder and the internal duct means of the other trunnion being connected at its opposite end with the other end of the cylinder.

9. A valve stroke control device according to claim 1 wherein the tappet is freely rotatable about its axis relative to the push rod.

10. The combination with an overhead valve internal combustion engine having a removable head, a poppet valve mounted in the head, a return spring for returning the valve from open to closed position, a timing gear train, a rotatable cam driven by the train, a reciprocable tappet carried by the engine and movable axially in opposite directions, respectively, and driven by the cam in one of said directions for opening the valve, and returned to starting position by the return spring;

a rocker mounted on the engine head for rocking about a fixed axis, from a starting closed valve position, in one direction in which said rocker opens the valve, and in an opposite direction in which said rocker permits returning of the valve to closed position by the spring;

said rocker having a valve engaging portion spaced a fixed distance from its rocking axis and by which the driving force imparted by the tappet is applied to the valve for opening the valve, and having a drive force receiving portion on said rocker and spaced at the opposite side of the rocking axis from the valve engaging portion;

an elongated push rod;

first connecting means connecting one end of the rod to the driving end of the tappet, so that the rod is driven by the tappet in the valve opening direction and so that the rod is swingable about said one end as a center toward and away from said rocker axis;

adjustment means fixedly mounted on said force receiving portion of the rocker for rocking therewith and including an adjustment element movable relative to the rocker transversely of said rocking axis in opposite directions from a long stroke position spaced a predetermined distance from said rocking axis to a short stroke position which is a different distance from said rocking axis than said predetermined distance and reverse;

additional connecting means connecting the other end of the push rod to said element for movement of said other end with the element in said opposite directions for swinging the rod transversely of its axis about said one end of the rod by the element, to said long stroke and short stroke positions, respectively, and for concurrent movement of the rod along the rod axis with the element in said long stroke and short stroke positions, respectively, as the element rocks with the rocker in each of said positions;

said adjustment means further including driving means for driving said element in said opposite directions, respectively, to said long stroke and short stroke positions, selectively, independently of the rotated position of said cam, and for holding the element in the selected one of said positions, thereby to move said other end of the rod to said long stroke and short stroke positions, selectively;

said element being arranged so that said starting position of the valve is the same in both said long stroke and short stroke positions of the element and rod and while the timing relation between the cam and the initiation of valve opening remains unchanged; and power means for supplying power to the driving means, and remotely controllable means operable to control the delivery of power to the driving means in a manner to drive said element to said long stroke and short stroke positions, selectively, and to hold the element in the selected one of said positions.

* * * * *